United States Patent [19]

Tamura et al.

[11] Patent Number: 4,508,664

[45] Date of Patent: Apr. 2, 1985

[54] VARIABLE VENTURI-TYPE CARBURETOR

[75] Inventors: Yoshio Tamura; Takaaki Ito, both of Mishima; Toshiharu Morino, Susono, all of Japan

[73] Assignees: Toyota Jidosha Kabushiki Kaisha; Aisan Industry Co., Ltd., both of Japan

[21] Appl. No.: 544,988

[22] Filed: Oct. 24, 1983

[30] Foreign Application Priority Data

Mar. 23, 1983 [JP] Japan ..... 58-047296

[51] Int. Cl.[3] ..... F02M 9/06

[52] U.S. Cl. ..... 261/44 C; 261/121 A

[58] Field of Search ..... 261/44 C, 44 B, 121 A, 261/DIG. 55

[56] References Cited

U.S. PATENT DOCUMENTS

| | | | |
|---|---|---|---|
| 1,088,231 | 2/1914 | Lawrence | 261/44 C |
| 3,456,929 | 7/1969 | Lawrence | 261/44 C |
| 4,185,054 | 1/1980 | Nakamura et al. | 261/44 C |
| 4,302,405 | 11/1981 | Inoue et al. | 261/44 C |
| 4,341,723 | 7/1982 | Hirowasa | 261/44 C |
| 4,434,111 | 2/1984 | Teramura et al. | 261/44 C |
| 4,444,695 | 4/1984 | Nakamura et al. | 261/44 C |

FOREIGN PATENT DOCUMENTS

| | | | |
|---|---|---|---|
| 747986 | 10/1944 | Fed. Rep. of Germany | 261/44 B |
| 972281 | 1/1951 | France | 261/44 B |
| 1081817 | 12/1954 | France | 261/44 B |
| 52-27931 | 3/1977 | Japan | 261/44 C |
| 152442 | 10/1920 | United Kingdom | 261/44 B |

*Primary Examiner*—Tim Miles

*Attorney, Agent, or Firm*—Finnegan, Henderson, Farabow, Garrett & Dunner

[57] ABSTRACT

A variable venturi-type carburetor comprising a suction piston and a needle. The root portion of the needle is fixed onto the central portion of the tip face of the suction piston. An annular groove is formed on the tip face of the suction piston around the root portion of the needle. A narrow groove is also formed on the tip face of the suction piston and extends downwardly from the annular groove to the downstream end of the tip face of the suction piston.

7 Claims, 4 Drawing Figures

VARIABLE VENTURI-TYPE CARBURETOR

BACKGROUND OF THE INVENTION

1. Field of the Invention

The present invention relates to a variable venturi-type carburetor for use in an internal-combustion engine.

2. Description of the Prior Art

A so-called downdraft variable venturi-type carburetor is known which comprises a substantially vertically-extending intake passage, a suction piston movable in the intake passage in a substantially horizontal direction, a needle fixed onto the tip face of the suction piston, and a fuel passage extending in the axial direction of the needle so that the needle is able to enter the fuel passage. The suction piston in this type of downdraft variable venturi carburetor normally has a flat tip face, and the root portion of the needle is fixed onto the central portion of the flat tip face. However, part of the fuel flowing within the fuel passage flows on the needle, reaches the tip face of the suction piston, and flows downward on the tip face of the suction piston. Consequently, at this time, if the tip face of the suction piston is so formed that it is flat, the flow path of the fuel flowing downward on the tip face of the suction piston fluctuates. If the flow path of the fuel fluctuates, the length of time during which the fuel flows downward on the tip face of the suction piston fluctuates, and, as a result, the amount of fuel fed into the cylinder of the engine fluctuates. In addition, fuel droplets sometimes form while the fuel is flowing downward on the tip face of the suction piston and then intermittently drop off. However, as was mentioned above, if the amount of fuel flowing downward on the tip face of the suction piston and fed into the cylinder of the engine fluctuates, or if the fuel droplets intermittently drop off, the air-fuel ratio is caused to fluctuate considerably, particularly when the amount of air fed into the engine cylinder is small, as when the engine is in an idle state. This results in a problem in that it is difficult to atttain stable operation of the engine.

SUMMARY OF THE INVENTION

An object of the present invention is to provide a variable venturi-type carburetor capable of attaining stable engine operation by suppressing fluctuation of the air-fuel ratio when the amount of air fed into the engine cylinder is small.

According to the present invention, there is provided a variable venturi-type carburetor comprising: a substantially vertically- and axially-extending intake passage formed in the carburetor; a suction piston substantially horizontally movable in the intake passage in response to a change in the amount of air flowing within the intake passage, the suction piston having a tip face which defines a venturi in the intake passage; a fuel passage extending substantially horizontally in the carburetor and being open to the intake passage, the fuel passage having a metering jet therein; a needle extending through the fuel passage and the metering jet and having a root portion which is fixed onto a central portion of the tip face of the suction piston, the tip face of the suction piston having an annular groove which is formed thereon around the root portion of the needle and having a narrow passage which is formed thereon and extends downwardly from the annular groove to the downstream end of the tip face of the suction piston in the axial direction of the intake passage.

The present invention may be more fully understood from the description of the preferred embodiment thereof set forth below with reference to the accompanying drawings.

DESCRIPTION OF THE PREFERRED EMBODIMENT

Figure 1:
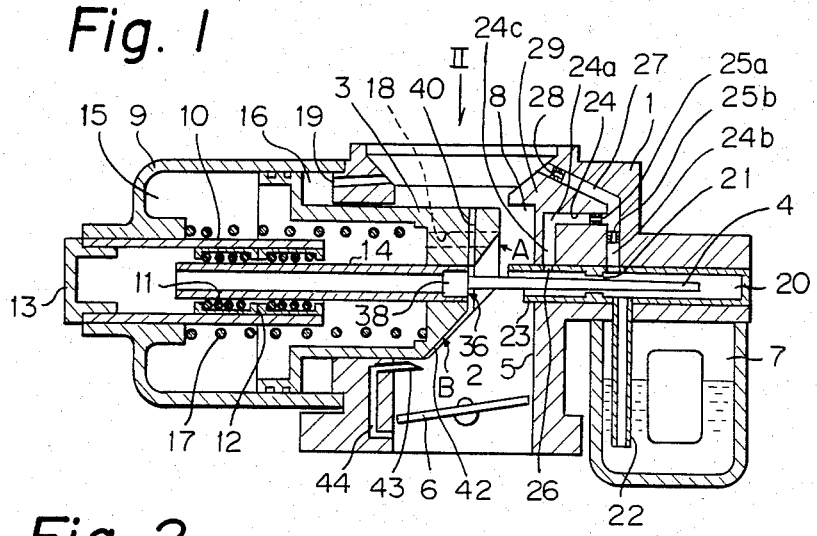
FIG. 1 is a cross-sectional side view of a variable venturi-type carburetor according to the present invention.

Referring to FIG. 1, reference numeral 1 designates a carburetor body, 2 a vertically-extending intake passage, 3 a suction piston transversely movable in the intake passage 2, 4 a needle fixed onto the tip face of the suction piston 3, 5 the inner wall of the intake passage 2, 6 a throttle valve arranged in the intake passage 2 downstream of the suction piston 3, and 7 a float chamber of the carburetor. A venturi 8 is formed between the inner wall 5 of the intake passage 2 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. A guide rod 14 is fixed onto the suction piston 3 and is inserted into the bearing 12 so as to be movable in the axial direction thereof. Since the suction piston 3 is supported by the casing 9 via the bearing 12, the suction piston 3 is able to smoothly move in the axial direction thereof. The interior of the casing 9 is divided into a vacuum chamber 15 and an atmospheric pressure chamber 16 by the suction piston 3, and a compression spring 17 for continuously biasing the suction piston 3 towards the venturi 8 is inserted into the vacuum chamber 15. The vacuum chamber 15 is connected to the venturi 8 via a suction hole 18 formed in the suction piston 3, and the atmospheric pressure chamber 16 is connected to the intake passage 2 upstream of the suction piston 3 via an air hole 19 formed in the carburetor body 1.

A fuel passage 20 is formed in the carburetor body 1 and extends in the axial direction of the needle 4 so that the needle 4 can enter the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially with the fuel passage 20, is fixed onto the inner wall 5 of the intake passage 2. The nozzle 23 projects from the inner wall 5 into the venturi 8, and the upper half of the tip portion of the nozzle 23 projects beyond the lower half of the tip porton of the nozzle 23 towards the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

As is illustrated in FIG. 1, the portion of the fuel passage 20 located upstream of the metering jet 21 is connected to the portion of the fuel passage 20 located downstream of the metering jet 21 via a fuel bypass passage 24. The fuel bypass passage 24 comprises a substantially horizontally-extending intermediate passage portion 24*a*, a fuel inflow passage portion 24*b* extending to the portion of the fuel passage 20 located upstream of the metering jet 21 from one end of the intermediate passage portion 24*a*, and a fuel outflow passage portion 24*c* extending to the portion of the fuel passage 20 located downstream of the metering jet 21 from the other end of the intermediate passage portion 24*a*. Fuel metering jets 25*a* and 25*b* are inserted into the intermediate passage portion 24*a* and the fuel inflow passage portion 24*b*, respectively. In addition, the lower end of the fuel outflow passage portion 24*c* is connected to the fuel passage 20 via a jet 26, and the connecting portion of the intermediate passage portion 24*a* and the fuel inflow passage portion 24*b* is connected to the intake passage 2 upstream of the suction piston 3 via an air bleed passage 27 and an air bleed jet 28.

Figure 2:
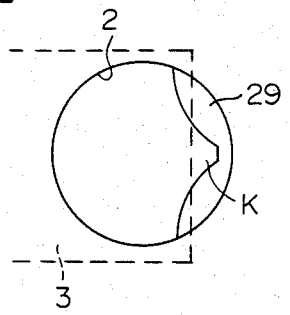
FIG. 2 is a plan view taken along the arrow II in FIG. 1.

As is illustrated in FIGS. 1 and 2, a raised wall 29 projecting horizontally into the intake passage 2 is formed on the inner wall 5 of the intake passage 2 above the nozzle 23, and flow control is effected between the raised wall 29 and the tip end portion of the suction piston 3. When the engine is started, air flows downward within the intake passage 2. At this time, since airflow is restricted between the suction piston 3 and the raised wall 29, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant. As is illustrated in FIG. 2, the raised wall 29 has a V-shaped cross section which diverges towards the intake passage 2. Therefore, when the amount of air fed into the engine cylinder is small, an approximately isosceles triangle-shaped air inflow opening K is formed between the raised wall 29 and the tip face of the suction piston 3. By forming the raised wall 29 so that it has a V shape, the piston 3 can move smoothly when the amount of air fed into the engine cylinder is increased and when the engine is in an operating state where the amount of air is small.

Figure 4:
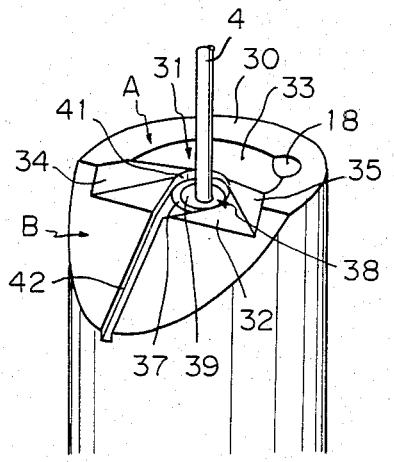
FIG. 4 is a perspective view of the suction piston of FIG. 1.
Figure 3:
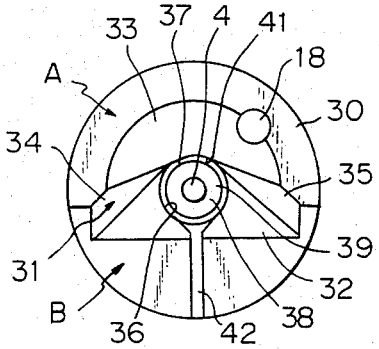
FIG. 3 is a plan view of the tip face of the suction piston of FIG. 1.

As is illustrated in FIGS. 1, 3, and 4, the tip face of the suction piston 3 comprises a substantially vertically-extending upstream portion A and an inclined, flat, downstream portion B which is directed downward. The upstream portion A has a sector-shaped flat face 30 at the periphery thereof, and a recess 31 is formed on the central portion of the tip face of the suction piston 3. The recess 31 has an approximately isosceles triangle-shaped flat bottom wall 32, and the outer periphery of the bottom wall 32 and the inner periphery of the sector-shaped flat face 30 are interconnected via a conical face 33 and steeply inclined flat faces 34 and 35. An annular groove 36 is formed on the flat bottom wall 32, and the end face 37 of the guide rod 14 is exposed to the interior of the annular groove 36. A needle holder 38 supporting the root portion of the needle 4 is fitted into the guide rod 14, and the outer end face 39 of the needle holder 38 and the end face 37 of the guide rod 14 are located in the same plane. Consequently, the outer end face 39 of the needle holder 38 and the end face 37 of the guide rod 14 define the bottom wall of the annular groove 36. A vertically-extending air-introduction bore 40 (FIG. 1) is formed in the suction piston 3, and the inlet of the air-introduction bore 40 is open to the intake passage 2 upstream of the suction piston 3. The outlet of the air-introduction bore 40 is formed on the circumferential wall 41 of the annular groove 36 directly above the needle 4. Thus, the outlet of the air-introduction bore 40 is open to the annular groove 36 just above the needle 4. A narrow groove 42 extending, in the direction of airflow, over the entire length of the downstream portion B is formed on the downstream portion B, and the upstream end of the narrow groove 42 is connected to the downstream end of the annular groove 36. As is illustrated in FIG. 1, a fuel-trapping tube 43 is arranged in the vicinity of the downstream end of the narrow groove 42. The fuel-trapping tube 43 is connected to the intake passage 2 downstream of the throttle valve 6 via a fuel passage 44 formed in the carburetor body 1.

When the engine is in an idle state, since the area of the annular gap formed between the needle 4 and the metering jet 21 is small, part of the fuel is fed into the nozzle 23 from the annular gap, and the rest of the fuel is fed into the nozzle 23 from the jet 26 via the fuel bypass passage 24. Air is fed from the air bleed passage 27 into the fuel flowing within the fuel bypass passage 24. Thus, the fuel, containig air bubbles therein, is fed into the nozzle 23 from the jet 26. The fuel fed into the nozzle 23 via the annular gap between the needle 4 and the metering jet 21 moves forward along the bottom wall of the nozzle 23. When the fuel reaches the tip of the nozzle 23, the airstream provides the shearing force for the fuel, and, thus, the fuel is atomized. Contrary to this, the fuel flowing out the jet 26 is pulled, by a vacuum produced in the venturi 8, forward along the upper wall of the fuel passage 20. At this time, part of the fuel adheres to the needle 4 and flows thereon towards the needle holder 38. Then it reaches the bottom face of the annular groove 36. Next, it flows downward on the bottom face of the annular groove 36 and into the narrow groove 42. Finally, it flows downward within the narrow groove 42 and reaches the downstream end thereof, where it is sucked into the fuel-trapping tube 43 and is fed into the intake passage 2 downstream of the throttle valve 6. As was mentioned above, since the fuel fed into the annular groove 36 via the needle 4 continuously flows within the annular groove 36 and the narrow groove 42, the amount of fuel fed into the engine cylinder does not fluctuate, thereby making it possible to prevent the air-fuel ratio from fluctuating. In addition, air is injected into the annular groove 36 from the air-introduction bore 40 and pushes the fuel in the annular groove 36 downward. Consequently, since the fuel is caused to flow downward instead of remaining in the annular groove 36, it is possible to prevent fuel droplets from forming on the tip face of the sucton piston and then dropping off.

If the amount of air fed into the engine cylinder is increased, the suction piston 3 moves towards the vacuum chamber 15. At this time, since the area of the annular gap formed between the needle 4 and the metering jet 21 is increased, the amount of fuel fed from the nozzle 23 is increased.

According to the present invention, since the fuel fed into the annular groove 36 via the needle 4 continuously flows downward along the same flow path while being guided by the annular groove 36 and the narrow groove 42, there is no danger of the amount of fuel fed into the engine cylinder fluctuating. In addition, since the fuel which has reached the annular groove 36 does not form on the tip face of the suction piston droplets which intermittently drop off, there is no danger of the air-fuel mixture fed into the engine cylinder temporarily becoming rich. Consequently, when the amount of air fed into the engine cylinder is small, as when the engine is in an idle state, it is possible to prevent the air-fuel ratio from fluctuating, thereby attaining stable engine operation.

While the invention has been described with reference to a specific embodiment chosen for purposes of illustration, it should be apparent that numerous modifications could be made thereto by those skilled in the art without departing from the basic concept and scope of the invention.

We claim:

1. A variable venturi-type carburetor comprising:

(a) a substantially vertically and axially extending intake passage formed in said carburetor;

(b) a suction piston substantially horizontally movable in said intake passage in response to a change in the amount of air flowing within said intake passage, said suction piston having a tip face which defines a venturi in said intake passage;

(c) a fuel passage extending substantially horizontally in said carburetor and being open to said intake passage, said fuel passage having a metering jet therein;

(d) a needle extending through said fuel passage and said metering jet and having a root portion which is fixed onto a central portion of the tip face of said suction piston;

(e) the tip face of said suction piston including (1) an annular groove around the root portion of said needle, said annular groove being defined by a generally planar bottom surface and a circumferential wall spaced from said root; and (2) a narrow passage extending in the axial direction of said intake passage from an upstream inlet communicating with said annular groove to a downstream outlet at the downstream end of said tip face, the upstream inlet of said narrow passage being defined by a base surface and opposed side walls, said base surface smoothly merging with the bottom surface of said annular groove; and (f) an air-introduction bore into said suction piston having an inlet port communicating with the inlet passage upstream of said suction piston and an outlet port in said circumferential wall above said needle communicating with said annular groove, said bore at said outlet port being tangent to the plane of said bottom surface.

2. A variable venturi-type carburetor according to claim 1, wherein the tip face includes an upstream portion having a flat peripheral face and wherein said carburetor includes a raised wall formed on the inner wall of said intake passage to cooperate with a peripheral edge of said flat peripheral face for restricting air flow therebetween.

3. A variable venturi-type carburetor according to claim 2, wherein said raised wall has a V-shaped cross section which diverges towards said intake passage so that an approximately isosceles triangle-shaped air inflow opening is formed between said raised wall and said flat peripheral face when the amount of air flowing within said intake passage is small.

4. A variable venturi-type carburetor according to claim 2, wherein the tip face of said suction piston has a recess formed at the central portion thereof and has an approximately isosceles triangle-shaped bottom wall on which said annular groove is formed.

5. A variable venturi-type carburetor according to claim 4, wherein the flat peripheral face of the upstream portion of the tip face of said suction piston has a sector shape and the tip face of said suction piston has a conical shape between said sector-shaped flat peripheral face and said isosceles triangle-shaped bottom wall.

6. A variable venturi-type carburetor according to claim 2, wherein the tip face of said suction piston has an inclined, flat, downstream portion which is directed downward, said narrow passage being formed on said downstream portion and extending over the entire length thereof.

7. A variable venturi-type carburetor according to claim 6, further comprising a fuel-trapping tube which is connected to said intake passage downstream of the throttle valve of said carburetor and which has an inlet arranged in the vicinity of the downstream end of said narrow passage.

* * * * *